US007660426B2

(12) United States Patent
Hannibal et al.

(10) Patent No.: US 7,660,426 B2
(45) Date of Patent: Feb. 9, 2010

(54) HEARING AID FITTING SYSTEM WITH A CAMERA

(75) Inventors: Steven Charles Hannibal, Copenhagen (DK); Phat Andrew Phan, Skokie, IL (US); Gregory Brian Olsen, Glen Ellyn, IL (US)

(73) Assignee: GN ReSound A/S (DK)

( * ) Notice: Subject to any disclaimer, the term of this patent is extended or adjusted under 35 U.S.C. 154(b) by 778 days.

(21) Appl. No.: 11/375,972

(22) Filed: Mar. 14, 2006

(65) Prior Publication Data

US 2006/0204013 A1 Sep. 14, 2006

Related U.S. Application Data

(60) Provisional application No. 60/661,381, filed on Mar. 14, 2005.

(51) Int. Cl.
*H04R 25/00* (2006.01)

(52) U.S. Cl. ..... 381/312; 381/60

(58) Field of Classification Search ..... 381/60, 381/312, 314, 322, 324, 328
See application file for complete search history.

(56) References Cited

U.S. PATENT DOCUMENTS

| | | | |
|---|---|---|---|
| 5,835,611 | A | 11/1998 | Kaiser et al. |
| 6,449,372 | B1 | 9/2002 | Greminger |
| 6,574,340 | B1 | 6/2003 | Bindner et al. |
| 6,574,342 | B1 | 6/2003 | Davis et al. |
| 2002/0010496 | A1 | 1/2002 | Greenberg et al. |
| 2002/0111745 | A1 | 8/2002 | Bye et al. |
| 2003/0223083 | A1 | 12/2003 | Geng |
| 2004/0041929 | A1 | 3/2004 | Lapalme et al. |

FOREIGN PATENT DOCUMENTS

| | | | |
|---|---|---|---|
| DE | 101 47 812 | A1 | 4/2003 |
| EP | 1 083 769 | A1 | 3/2001 |
| WO | WO 90/09760 | | 9/1990 |
| WO | WO 98/56209 | | 12/1998 |
| WO | WO 01/08443 | A3 | 2/2001 |

OTHER PUBLICATIONS

European Search Report in related application EP 06 07 5611 mailed Jun. 7, 2006.

*Primary Examiner*—Suhan Ni
(74) *Attorney, Agent, or Firm*—Vista IP Law Group, LLP.

(57) ABSTRACT

A hearing aid fitting system comprising a computer with fitting software and having a display for displaying parameter settings of a hearing aid and input means for adjustment of the parameters, characterized in that the system further comprises a camera for recording images of the wearer's head including the ear with the hearing aid, and a display for displaying at least one image received from the camera.

12 Claims, 3 Drawing Sheets
(2 of 3 Drawing Sheet(s) Filed in Color)

HEARING AID FITTING SYSTEM WITH A CAMERA

RELATED APPLICATIONS

This application claims benefit of U.S. Provisional Application No. 60/661,381 filed Mar. 14, 2005, which is incorporated by reference in its entirety.

FIELD

The present application relates to a hearing aid fitting system for a programmable hearing aid device.

BACKGROUND

Hearing aid fitting systems are well known in the art, e.g. cf. U.S. Pat. No. 5,835,611. Such systems have proven adequate for adjusting signal processing parameters so that the hearing aid accurately compensates the actual hearing loss of the hearing aid wearer.

The fitting process typically involves measuring the auditory characteristics of an individual's hearing, estimating the acoustic characteristics needed to compensate for the particular auditory deficiency measured, adjusting the auditory characteristics of the acoustic hearing aid so that the appropriate acoustic characteristics may be delivered, and verifying that these particular auditory characteristics do compensate for the hearing deficiency found by operating the acoustic hearing aid in conjunction with the individual.

Standard techniques are known for these fittings which are typically performed by an audiologist, hearing aid dispenser, otologist, otolaryngologist, or other doctor or medical specialist.

In the well-known methods of acoustically fitting a hearing aid to an individual, the threshold of the individual's hearing is typically measured using an audiometer, i.e. a calibrated sound stimulus producing device and calibrated headphones. The measurement of the threshold of hearing takes place in a room with very little audible noise.

Generally, the audiometer generates pure tones at various frequencies between 125 Hz and 8,000 Hz. These tones are transmitted to the individual being tested, e.g. through headphones of the audiometer. Normally, the tones are presented in step of an octave or half an octave. The intensity or volume of the pure tones is varied and reduced until the individual can just barely detect the presence of the tone. This intensity threshold is often defined and found as the intensity of which the individual can detect 50% of the tones presented. For each pure tone, this intensity threshold is known as the individual's air conduction threshold of hearing. Although the threshold of hearing is only one element among several that characterizes an individual's hearing loss, it is the predominant measure traditionally used to acoustically fit a hearing aid.

Once the threshold of hearing in each frequency band has been determined, this threshold is used to estimate the amount of amplification, compression, and/or other adjustment that will be employed to compensate for the individual's loss of hearing. The implementation of the amplification, compression, and/or other adjustments and the hearing compensation achieved thereby depends upon the hearing aid being employed. There are various formulas known in the art which have been used to estimate the acoustic parameters based upon the observed threshold of hearing. These include generic rules, such as NAL and POGO, which may be used when fitting hearing aid from most hearing aid manufactures. There are also various proprietary methods used by various hearing aid manufacturers. Additionally, based upon the experience of the person performing the testing and the fitting of the hearing aid to the individual, these various formulas may be adjusted.

SUMMARY

Typically, however, the wearer is very concerned with his or her appearance wearing a hearing aid, and often to a degree that the wearer finds it hard to concentrate on the above-mentioned audiological measurements and adjustments performed. Thus, there is a need for a hearing aid fitting system that allows the wearer of the hearing aid to check his or her appearance while wearing the hearing aid.

According to some embodiments, the above-mentioned and other objects are fulfilled by provision of a hearing aid fitting system comprising a computer with fitting software and having a display for displaying parameter settings of the hearing aid and input means for adjustment of the parameters, characterized in that the system further comprises a camera that is positioned so that its field of view includes the wearer of the hearing aid for recording images of the wearer's ear with the hearing aid.

The hearing aid fitting system is further adapted for displaying images received from the 25 camera. The images may be displayed as a live video stream from the camera, or a selected frame may be displayed in a window, or a video may be recorded and displayed in the window, e.g. in an endless loop.

This allows the hearing aid wearer to evaluate his or her appearance with a selected hearing aid inserted in the ear or positioned behind the ear.

In a preferred embodiment of the hearing aid fitting system, the operator of the system may change the displayed color of the hearing aid in the wearer's ear allowing the hearing aid wearer to evaluate and compare his or her appearance with differently colored hearing aids without actually wearing the hearing aid with the displayed color.

Images of the hearing aid wearer with hearing aids of various colors may be stored for simultaneous display for easy comparison and possible selection by the hearing aid wearer.

The camera may be positioned in a fixed position with the intended position of the hearing aid wearer's ear with the hearing aid in the field of view of the camera. The hearing aid wearer may turn his or her head or change his or her position to obtain images of the head with the hearing aid from different angles. Alternatively, the camera may be mounted on a movable support allowing recording images of the wearer's head from selectable angles. The position of the support may be adjustable in three dimensions, e.g. the support may be movable in a horizontal plane, and its height may be adjustable.

Further, the hearing aid fitting system may comprise two cameras positioned to obtain images of the left and the right ear, respectively, of the hearing aid wearer. Both cameras may be mounted on a movable support as mentioned above.

The hearing aid fitting system may be adapted for simultaneous display of an image of the right ear and the left ear.

The movable support may be controlled by the computer for easy adjustment of the position of the camera and thereby the field of view and angle of view of each or both ears of the hearing aid wearer.

The hearing aid fitting system may further be adapted for storage of recorded images of the hearing aid wearer.

The hearing aid fitting system may further be adapted for password protected access to stored images.

The hearing aid fitting system may further comprise a communication port for connection with a hearing aid supplier for communication of images of the wearer's ear and of the hearing aid housing. The system may for example communicate with suppliers of hearing aids through the Internet. Further, the camera may be used for recording of close-up images of the outer ear and the entrance to the ear canal of the hearing aid wearer, and also close-ups of a hearing aid housing intended for the hearing aid wearer in question for transmission to the manufacturer of a specific hearing aid. This may for example allow the hearing aid manufacturer to make corrections to a custom made hearing aid housing without the need to make a new impression of the ear canal and the outer ear of a hearing aid wearer, or this feature may facilitate communication with the hearing aid supplier about other problems or possibilities.

The hearing aid fitting system may further comprise a communication port for connection with a camera that is positioned at a remote location, e.g. at the home of a hearing aid wearer. The communication may for example be carried out through the Internet, and may for example take place through a home page of the operator of the hearing aid system. The hearing aid fitting system may further be adapted for recording and storing images from the remote camera. This allows transmission of images of a hearing aid wearer's ear from the remote location to the hearing aid fitting system.

The hearing aid fitting system may further be adapted for password protected access to stored images from a remote location and displaying images of various hearing aids for selection and insertion into a selected stored image allowing appearance evaluation from the remote location.

The hearing aid fitting system may further be adapted for displaying images of various hearing aids and for inserting an image of a selected hearing aid into an image of the wearer's ear allowing the wearer to evaluate his appearance with the selected hearing aid without actually wearing the hearing aid.

The hearing aid fitting system may further be connected to a remote display unit, e.g. through the Internet, for displaying recorded images of the hearing aid wearer and for displaying images of various hearing aids and for inserting an image of a selected hearing aid into an image of the wearer's ear allowing the wearer to evaluate his appearance with the selected hearing aid without actually wearing the hearing aid.

The hearing aid wearer's selection of a hearing aid may be communicated from the remote location to the hearing aid fitting system, e.g. so that the selected hearing aid may be made available when the hearing aid wearer visits the operator of the hearing aid fitting system to try out the selected hearing aid.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

The embodiments will be explained more detailed in the following description with reference to the drawing, wherein

FIG. 1 is a photo showing utilization of a hearing aid fitting system 10 comprising a computer (located under the table) with fitting software and having a display 12 for displaying parameter settings of the hearing aid, e.g. the parameter setting is displayed using plots 14, and input means 16 for adjustment of the parameters. The system 10 further comprises a camera 18 that is positioned so that its field of view includes the wearer 20 of the hearing aid for recording images 22 of the wearer's ear 24 with the hearing aid.

The hearing aid fitting system 10 is further adapted for displaying a window 26 with images received from the camera. The images may be displayed as a live video stream from the camera, or a selected frame may be displayed in the window 26, or a video may be recorded and displayed in the window 26, e.g. in an endless loop.

As clearly illustrated in FIG. I, this allows the hearing aid wearer 20 to evaluate his or her appearance with a selected hearing aid inserted in the ear.

In a preferred embodiment of the hearing aid fitting system, the operator of the system may change the displayed color of the hearing aid in the wearer 20's ear allowing the hearing aid wearer 20 to evaluate and compare his or her appearance with differently colored hearing aids without actually wearing the hearing aid with the displayed color.

Images of the hearing aid wearer 20 with hearing aids of various colors may be stored for simultaneous display for easy comparison and possible selection by the hearing aid wearer 20.

In the illustrated embodiment, the camera 18 is positioned on a table and may be moved around as desired in order to obtain images of the hearing aid wearer 20's ear with the hearing aid in the field of view of the camera 18. The hearing aid wearer 20 may also turn his or her head or change his or her position to obtain images of the head with the hearing aid from different angles.

Figure 1:
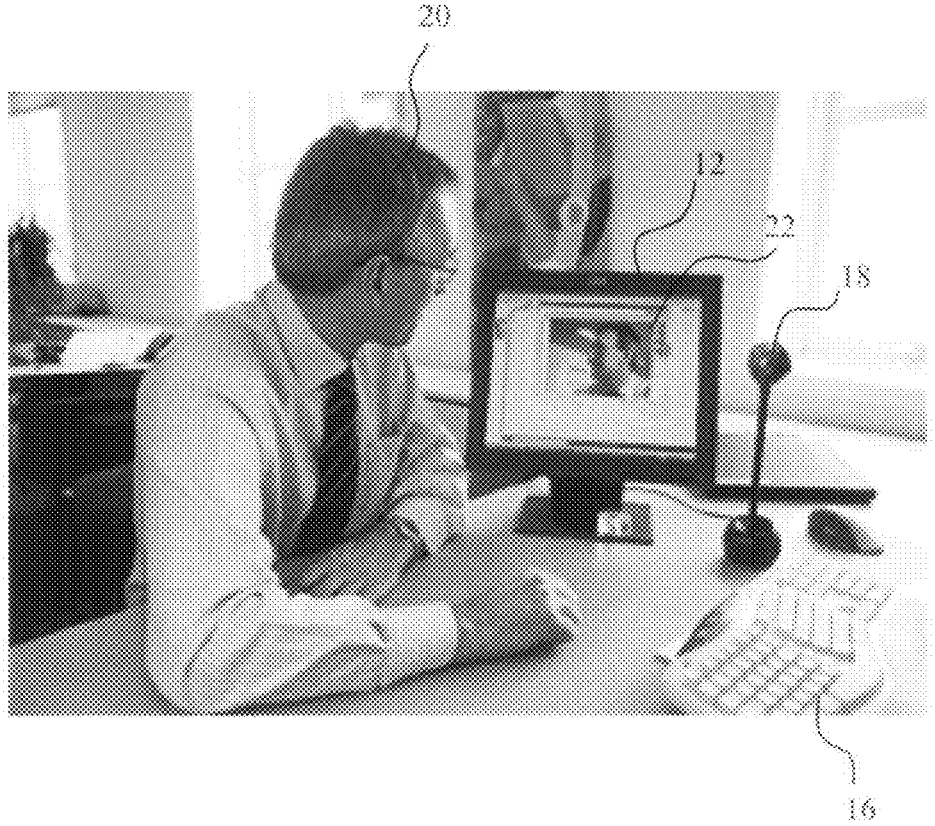
FIG. 1 is a photo of a hearing aid wearer and a hearing aid fitting system with a camera.
Figure 2:
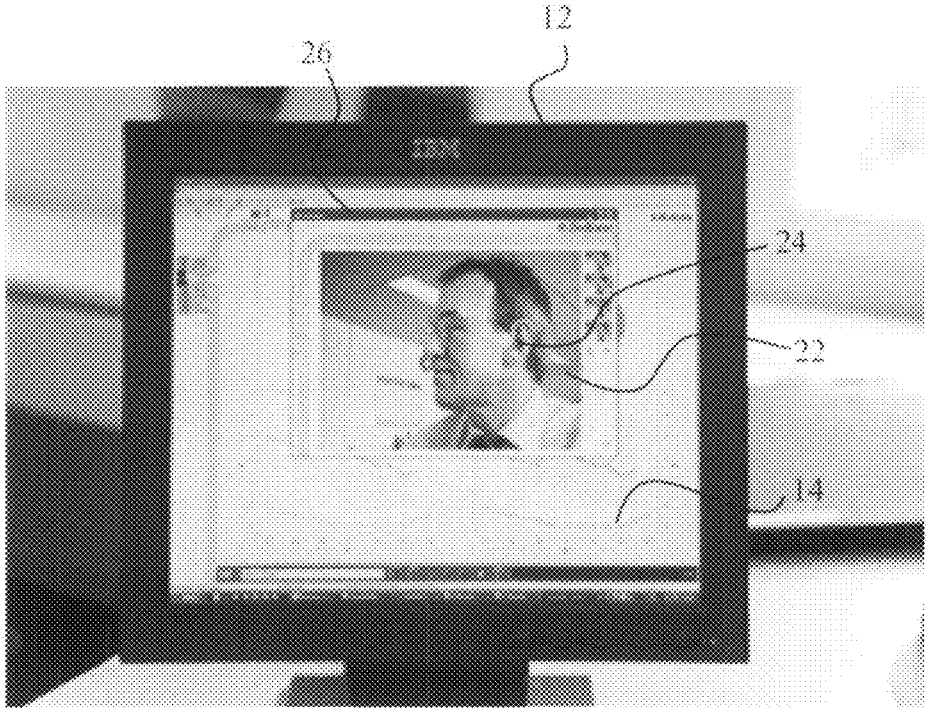
FIG. 2 is a photo of the display of the hearing aid fitting system of FIG. 1.
Figure 3:
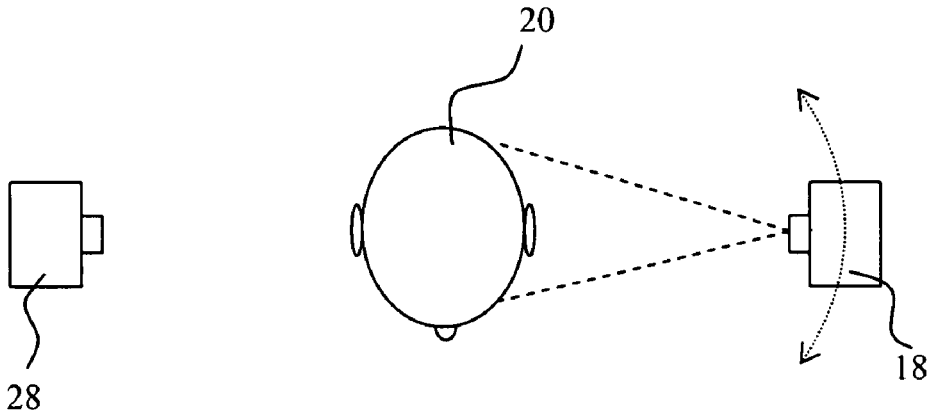
FIG. 3 illustrates schematically the positioning of cameras of a hearing aid fitting system in relation to the hearing aid wearer.

In another embodiment schematically illustrated in FIG. 3, the camera 18 is mounted on a movable support allowing recording images of the wearer 20's head from selectable angles. The illustrated support is rotatable in the horizontal plane around a point proximate to the hearing aid wearer 20, and its height is adjustable.

As also illustrated in FIG. 3, the hearing aid fitting system may comprise two cameras 18, 28 30 positioned to obtain images of the left and the right ear, respectively, of the hearing aid wearer 20. Both cameras 18, 28 may be mounted on a movable support as mentioned above.

The hearing aid fitting system may be adapted for simultaneous display of an image of the right ear and the left ear.

The movable supports are controlled by the computer for positioning of the camera 18, 28 in a desired position for easy adjustment of the field of view and angle of view of each or both ears of the hearing aid wearer 20.

The hearing aid fitting system is further adapted for storage of recorded images of the hearing aid wearer 20 providing password protected access to stored images.

The computer of the illustrated hearing aid fitting system is connected to the Internet for communication of images of the wearer 20's ear and of the hearing aid housing to the appropriate hearing aid manufacturer. Further, the camera 18 may be used for recording of close-up images of the outer ear and the entrance to the ear canal of the hearing aid wearer 20, and also close-ups of a hearing aid housing intended for the hearing aid wearer 20 in question for transmission to the manufacturer. This may for example allow the hearing aid manufacturer to make corrections to a custom made hearing aid housing without the need to make a new impression of the ear canal and the outer ear of a hearing aid wearer 20, or this feature may facilitate communication with the hearing aid supplier about other problems or possibilities.

The hearing aid wearer may also have a camera, such as a web camera, connected with a computer that is connected to the Internet so that the hearing aid wearer may communicate with the hearing aid fitting system, for example using a home page of the operator of the hearing aid system. The hearing aid fitting system is adapted for recording and storing images from the remote camera at the location of the hearing aid wearer. This allows transmission of images of a hearing aid wearer 20's ear from the remote location to the hearing aid fitting system. The transmitted images may be stored in the hearing aid fitting system.

Figure 4:
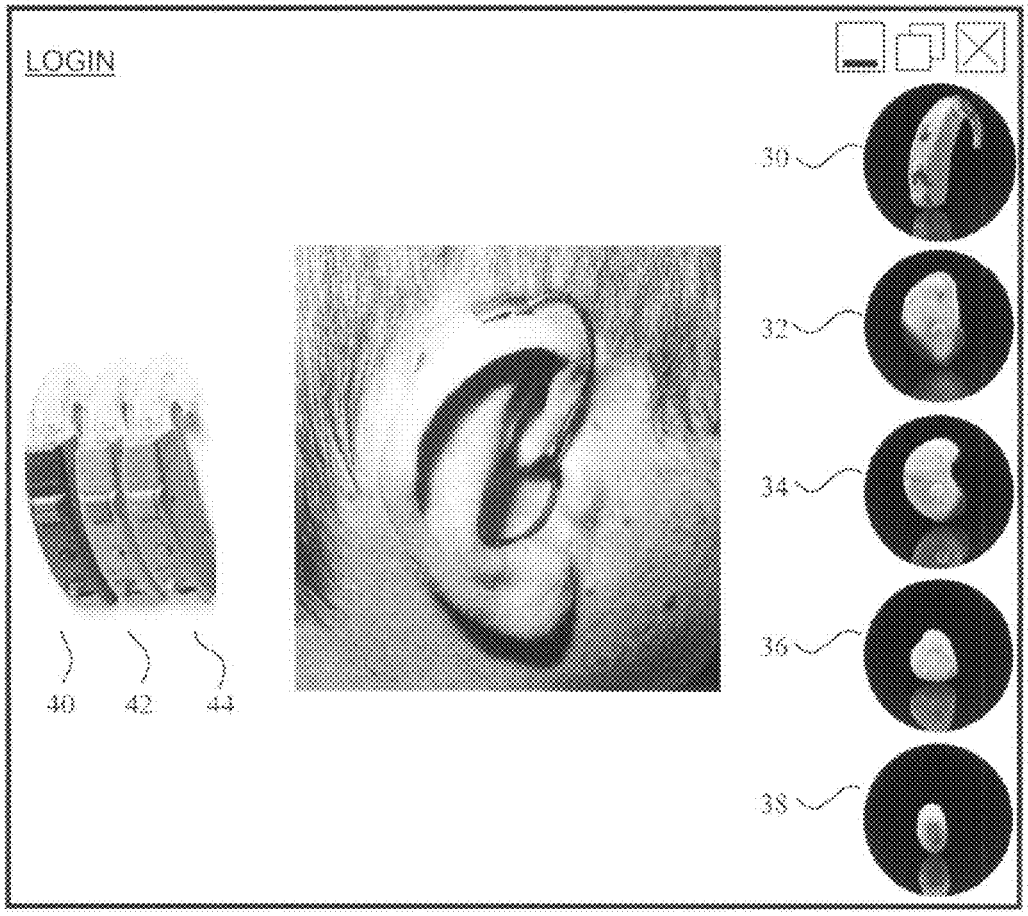
FIG. 4 is one of the windows displayed by the hearing aid fitting system.

As shown in FIG. 4, the hearing aid wearer may obtain password protected access to stored images 22 from a remote location, e.g. using a computer with an Internet connection. Further, the system displays images 30, 32, 34, 36, 38 of various hearing aids for selection and insertion into a selected stored image allowing appearance evaluation from the remote location without the hearing aid wearer actually wearing the selected types of hearing aids 30, 32, 34, 36, 38. The selected hearing aid, in the illustrated example, a BTE (Behind The Ear) hearing aid, is displayed in different colors 40, 42, 44 for selection of the color of the hearing aid that is virtually inserted in the image of the ear of the hearing aid wearer. In the same manner, a professional may also gain access to the stored images. Useful information for the adjustment of a hearing aid may hereby be gained. For example, a custom made hearing aid may be adjusted based on the image information, when needed. Obviously, the images may hereby also enable the professional to optimize the process as such as valuable information and knowledge may be gained from a number of cases over time.

The hearing aid fitting system may further be adapted for displaying images of various hearing aids and for inserting an image of a selected hearing aid into an image of the wearer 20's ear allowing the wearer 20 to evaluate his appearance with the selected hearing aid without actually wearing the hearing aid.

The hearing aid fitting system may further be connected to a remote display unit, e.g. through the Internet, for displaying recorded images of the hearing aid wearer 20 and for displaying images of various hearing aids and for inserting an image of a selected hearing aid into an image of the wearer 20's ear allowing the wearer 20 to evaluate his appearance with the selected hearing aid without actually wearing the hearing aid.

The hearing aid wearer 20's selection of a hearing aid may be communicated from the remote location to the hearing aid fitting system so that the selected hearing aid may be made available when the hearing aid wearer 20 visits the operator of the hearing aid fitting system to try out the selected hearing aid.

The invention claimed is:

1. A hearing aid fitting system comprising a computer with fitting software and having a display for displaying settings of parameters of a hearing aid and an input device for adjustment of the parameters, wherein that the system further comprises a camera for recording images of a head of a wearer of the hearing aid including an ear of the wearer and the hearing aid, and wherein the display is for displaying at least one of the images received from the camera.

2. The hearing aid fitting system according to claim 1, further comprising a moveable support for the camera for allowing recording of images of the wearer's head from selectable angles.

3. The hearing aid fitting system according to claim 2, wherein a position of the moveable support is controlled by the computer.

4. The hearing aid fitting system according to claim 1, further comprising a communication port for connection with a hearing aid supplier for communication of the images of the wearer's ear and the hearing aid.

5. The hearing aid fitting system according to claim 1, further adapted for changing a displayed color of the hearing aid in the wearer's ear, thereby allowing the hearing aid wearer to evaluate the wearer's appearance with the displayed color without actually wearing the hearing aid with the displayed color.

6. The hearing aid fitting system according to claim 1, wherein the display is for displaying images of various hearing aids and for inserting an image of a selected hearing aid into an image of the wearer's ear, thereby allowing the wearer to evaluate the wearer's appearance with the selected hearing aid without actually wearing the hearing aid.

7. The hearing aid fitting system according to claim 1, further adapted for storage of the recorded images of the hearing aid wearer.

8. The hearing aid fitting system according to claim 7, wherein the stored images are password protected and are accessible from a remote location.

9. The hearing aid fitting system according to claim 8, further adapted for communication of a hearing aid selection from the remote location to the hearing aid fitting system.

10. The hearing aid fitting system according to claim 8, further adapted for communication with a second camera at the remote location, thereby allowing transmission of images of another hearing aid wearer's ear from the remote location to the hearing aid fitting system.

11. The hearing aid fitting system according to claim 9, further adapted for communication with a second camera at the remote location, thereby allowing transmission of images of another hearing aid wearer's ear from the remote location to the hearing aid fitting system.

12. A fitting software for a hearing aid fitting system comprising a computer, a display, and an input device, wherein the fitting software is adapted for displaying on the display settings of parameters of a hearing aid and for adjusting the parameters based on input from the input device, wherein the fitting software is further adapted for receiving from a camera images of a head of a wearer of the hearing aid including an ear of the wearer and the hearing aid, and for displaying on the display at least one of the images received from the camera.

* * * * *